US009205536B2

(12) United States Patent
Clark

(10) Patent No.: US 9,205,536 B2
(45) Date of Patent: Dec. 8, 2015

(54) SPACING MEANS

(71) Applicant: Brett Clark, Taren Point (AU)

(72) Inventor: Brett Clark, Taren Point (AU)

( * ) Notice: Subject to any disclaimer, the term of this patent is extended or adjusted under 35 U.S.C. 154(b) by 0 days.

(21) Appl. No.: 14/527,010

(22) Filed: Oct. 29, 2014

(65) Prior Publication Data

US 2015/0113791 A1 Apr. 30, 2015

(30) Foreign Application Priority Data

Oct. 30, 2013 (AU) ..... 2013904184

(51) Int. Cl.

| | |
|---|---|
| ***E04D 15/00*** | (2006.01) |
| ***E04F 21/00*** | (2006.01) |
| ***E04G 21/14*** | (2006.01) |
| ***B25B 11/02*** | (2006.01) |
| ***E04H 17/26*** | (2006.01) |
| ***B25B 5/10*** | (2006.01) |

(52) U.S. Cl.

CPC ..... *B25B 11/02* (2013.01); *B25B 5/102* (2013.01); *E04H 17/26* (2013.01)

(58) Field of Classification Search

CPC ..... B25B 11/02; B25B 27/14; B25B 27/023; B25B 5/102; E04H 17/26; E04H 2017/146; E04F 21/1855; E04F 21/1844; Y10T 29/53978; Y10T 29/53983; Y10T 29/49901; Y10T 29/5397; Y10S 52/01; Y10S 269/91

See application file for complete search history.

(56) References Cited

U.S. PATENT DOCUMENTS

| | | | | |
|---|---|---|---|---|
| 1,057,799 | A * | 4/1913 | Bowerman | 144/288.5 |
| 5,092,028 | A * | 3/1992 | Harnden | 29/709 |
| 5,947,460 | A * | 9/1999 | Williams | 269/37 |
| 2005/0121844 | A1 * | 6/2005 | Fredrickson et al. | 269/37 |
| 2008/0084014 | A1 * | 4/2008 | Godwin et al. | 269/37 |

* cited by examiner

*Primary Examiner* — Brian D Mattei

(74) *Attorney, Agent, or Firm* — Kenyon & Kenyon LLP

(57) ABSTRACT

The present application is directed toward a spacing means for aiding spacing of a plurality of elongated slats or fence palings in a planar manner to a supporting structure, wherein the spacing means comprises an elongated spine and a plurality of wedges as described herein.

12 Claims, 12 Drawing Sheets

PRIOR ART
Fig. 1A
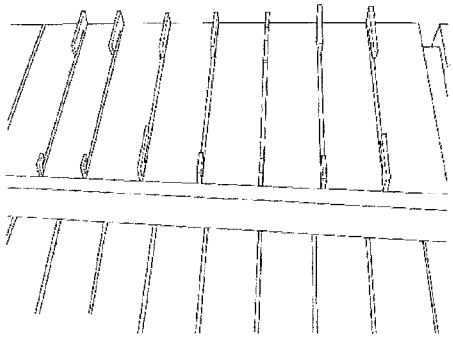
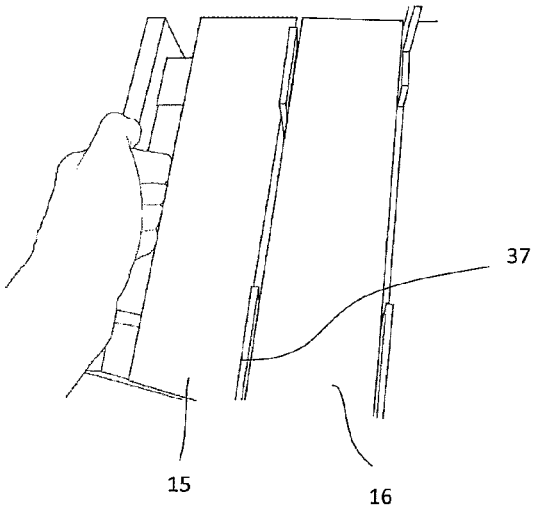
Fig. 1B
Fig. 1C
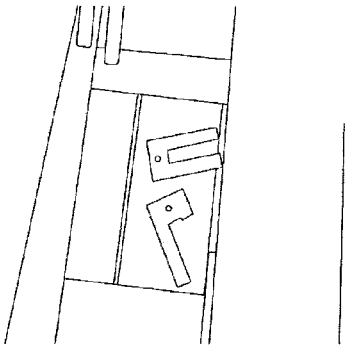

SPACING MEANS

CROSS-REFERENCE TO RELATED APPLICATION

The present application claims priority to Australian Patent Application No. 2013904184 filed on Oct. 30, 2013, the disclosure of which is incorporated herein by reference in its entirety.

FIELD OF THE INVENTION

The present invention relates to a spacing means and in particular to a spacing means for use in the building trade.

The invention solves several problems which arise when laying a deck or paling fence. The invention allows multiple boards to be fixed at the same time, the invention rectifies common problems of quality and inconsistency of the actual timber board being laid, and more than likely not every board you have received from the supplier is straight or the exact same width. The invention can be used for multiple width and thickness boards without changing anything.

The invention has been developed primarily for use in regard to decking or fence making or the like and generally with use of elongated timber slats and will be described hereinafter with reference to this application. However, it will be appreciated that the invention is not limited to this particular field of use. Further reconstituted wood or wood substitutes such as plastic or metal could be used.

Throughout this document reference to timber or wood such as in terms of "elongated wooden decking timbers" or "fence palings" includes "elongated slats or fence palings" of wood or timber or other materials.

BACKGROUND OF THE INVENTION

In decking there is non-overlapping fence making in which a plurality of elongated wooden decking timbers or fence palings need to be fitted in a planar manner to a supporting structure with spacing between each adjacent pair of decking timbers or fence palings. For appearance and necessity the spacing is required to be substantially consistently laterally spaced from decking timber to decking timber or from fence paling to fence paling as well as be spaced consistently along the longitudinal adjacent edges of decking timber to decking timber or fence paling to fence paling.

Presently, there are several manufacturers of plastic packers which are used to set the boards at the 5 millimeter spacing's. There are also sash clamps and other timber woodworking clamps that can be used, however they are terribly inefficient in the actual task of clamping more than say 4 or 5 boards or long runs of boards. Since most decking boards are supplied in 3 to 5 meter lengths in 300 millimeter increments most jobs are not successfully used. Particular problem is that when you are clamping the boards you need to hope the plastic packers don't fall down between the decking boards or move out of alignment as you will need to start the process again. The standard wood chisel is used to help pry and bend boards into a straight acceptable line, this is always a difficult procedure and you never have enough hands when carrying it out. Further there is not consistency along the length as the one tradesman or carpenter can only undertake one position of attachment at a time. It is not feasible to have multiple tradesman or carpenters but even then consistency is not achieved as each has their own style.

As shown in FIGS. 1A, 1B and 1C the prior art requires forcing the adjacent boards 15, 16 together by hand and spacing of multiple boards by use of loose packers 17 in between each pair of adjacent boards. At the same time the tradesman or carpenter needs to pick up the nail gun and still apply pressure to the boards when nailing off. As can be seen, there is only approximately 45 millimeter gap until the wall. Also when it goes wrong and the packers fall down it can be quite a time delay. This is amplified and even more frustrating when working on a second storey balcony.

The present invention seeks to provide a spacing means, which will overcome or substantially ameliorate at least one or more of the deficiencies of the prior art, or to at least provide a viable alternative.

It is to be understood that, if any prior art information is referred to herein, such reference does not constitute an admission that the information forms part of the common general knowledge in the art, in Australia or any other country.

SUMMARY OF THE INVENTION

According to a first aspect of the present invention there is provided a spacing means for aiding spacing of a plurality of elongated slats such as wooden decking timbers or fence palings in a planar manner to a supporting structure, the spacing means comprising an elongated spine having a plurality of wedges mounted thereon in a moveable manner between a first end and a second end wherein a pair of wedges are positionable on either side of an elongated wooden decking timbers or fence palings with each wedge forming at least first spacing dimension to adjacent elongated wooden decking timbers or fence palings.

The plurality of wedges can each be mounted on intermediate wedge mounts on the elongated spine between the first end and the second end. Preferably the plurality of wedges each have a consistent first dimension to allow consistent first dimensional spacing of the adjacent elongated wooden decking timbers or fence palings. The plurality of wedges can each have a consistent second dimension to allow consistent second dimensional spacing of the adjacent elongated wooden decking timbers or fence palings.

The spacing means can include a clamping means for urging a plurality of intermediate wedge mounts together slidably along the rod while the respective plurality of wedges can extend away from the rod and wedge between the plurality of elongated wooden decking timbers or fence palings in a planar manner.

The clamping means can be a separate C-type clamp or an integral worm drive or other clamping means. However preferably the spine has at least partially threaded rod with the spine holding the plurality of intermediate wedge mounts in a slidable manner with each of the wedges extending away from the rod.

The spacing means can have the spine holds the plurality of intermediate wedge mounts in a slidable manner from a first base fixedly mounted at the first end of the spine. The spine can further hold the plurality of intermediate wedge mounts in a slidable manner from a second base adjustably mounted at the second end of the spine.

Also the invention provides a method of spacing of a plurality of elongated wooden decking timbers or fence palings in a planar manner to a supporting structure, the method including the steps of: an elongated spine, having a plurality of wedges mounted thereon in a moveable manner between a first end and a second end, wherein a pair of wedges are positionable on either side of an elongated wooden decking timbers or fence palings with each wedge forming at least first spacing dimension to adjacent elongated wooden decking timbers or fence palings.

It can be seen that the invention of a spacing means provides the benefit of The spacing means is one tool that replaces consumable plastic packers, clamps and chisels. The spacing means allows multiple decking boards to be fixed in position at one time which speeds up the decking job.

The spacing means straightens bent boards and holds them there to be fixed off and can be adjusted to the mm. The spacing means can be used for various widths and thickness boards, most boards supplied today can vary 2 to 3 millimeter in width.

The spacing means can clamp boards together when directly against a wall or thresholds.

The spacing means has been designed to take the punishment of day to day life on the building site; it is designed to be hit with a hammer to allow the packer piece to wedge itself in between tight boards with no gap.

Other aspects of the invention are also disclosed.

BRIEF DESCRIPTION OF THE DRAWINGS

Notwithstanding any other forms which may fall within the scope of the present invention, preferred embodiments of the invention will now be described, by way of example only, with reference to the accompanying drawings in which:

FIGS. 1A, 1B and 1C are photographic views of the prior art using plastic spacers and manual strength and dexterity;

DESCRIPTION OF PREFERRED EMBODIMENTS

Figure 2:
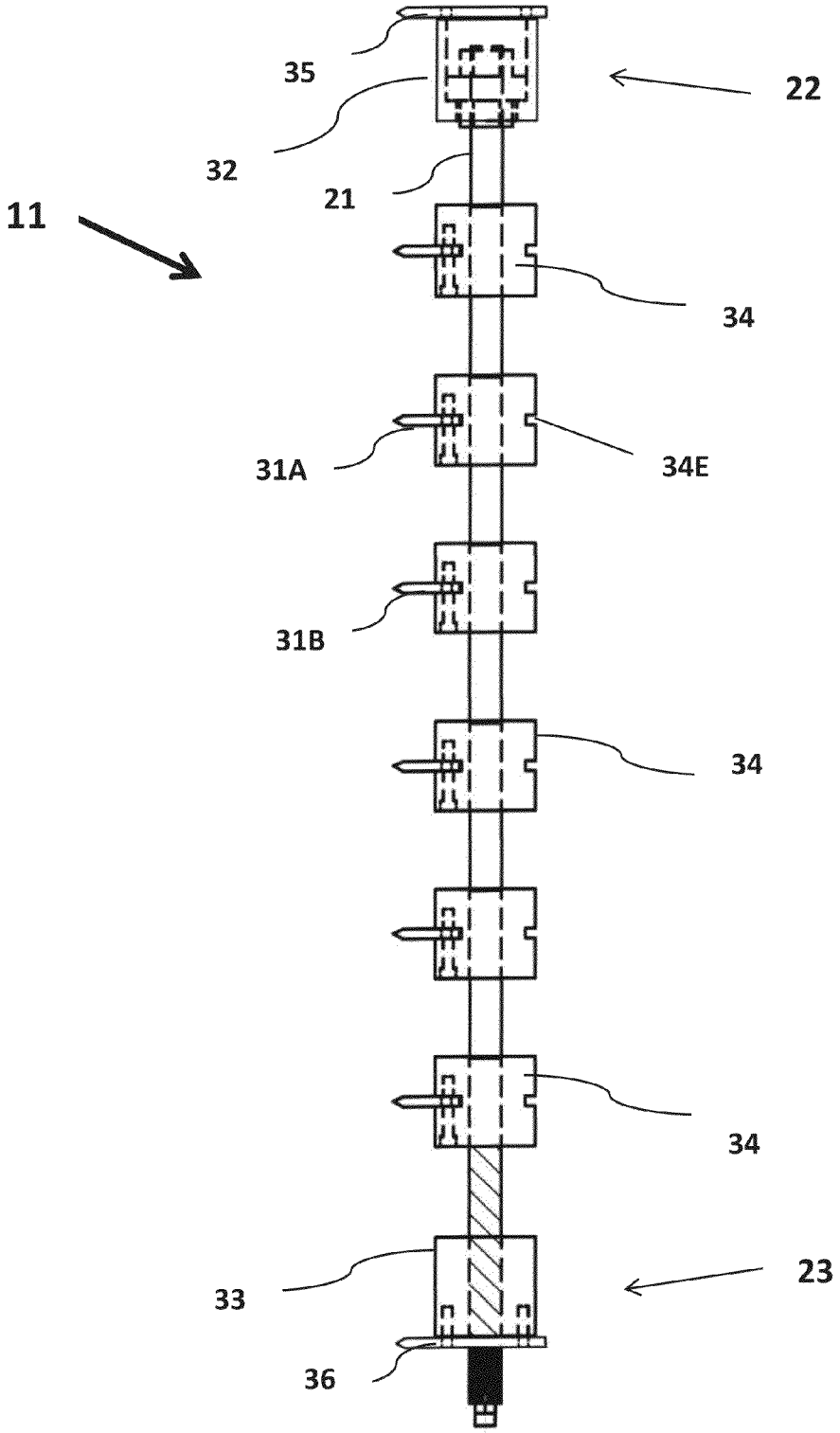
FIG. 2 is a diagrammatic cross-sectional view of a spacing means in accordance with a preferred embodiment of the present invention with a plurality of wedges mounted on intermediate wedge mounts in a slidable manner on the rod like spine.

It should be noted in the following description that like or the same reference numerals in different embodiments denote the same or similar features.

Referring to FIG. 2 there is shown a spacing means 11 for aiding spacing of a plurality of elongated wooden decking timbers or fence palings in a planar manner to a supporting structure. The spacing means 11 comprises an elongated spine 21 having a plurality of wedges 31 mounted thereon in a moveable manner between a first end 22 and a second end 23. In this way a pair of adjacent wedges 31A and 31B are positionable on either side of an elongated wooden decking timbers 15, 16 or fence palings with each wedge 31 forming at least first spacing dimension D1 to adjacent elongated wooden decking timbers or fence palings.

The spine 21 is a rod which at the first end 22 has a first base 32 fixedly mounted at the first end of the spine The spacing means spine 21 holds the plurality of plurality of wedges 31 mounted on intermediate wedge mounts 34 mounted on the spine rod 21 in a slidable manner between two end plates 35, 36.

Figure 3:
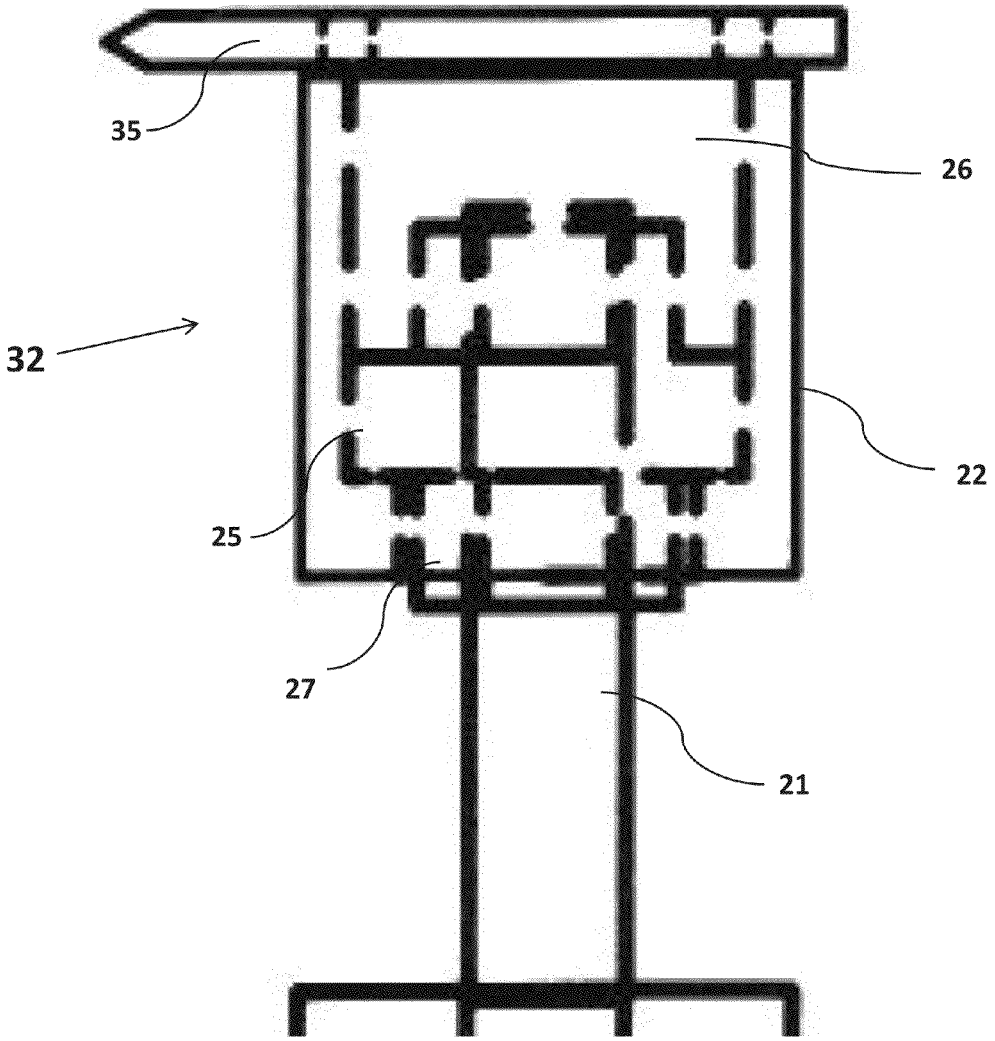
FIG. 3 is a detail of a first end of the spacing means of FIG. 2 showing a fixed base.

Looking at FIG. 3 there is shown a detail of an embodiment of a first base 32. The first base 32 is fixed to a first end 22 of the spine rod 21 by a fixed member 25 fixed to the rod 21 and having a dimension able to fit into a first cavity 26 extending into the body of the first base 32 from one end but not able to fit into a second cavity 27 extending from the first cavity to an exit 27 through which the rod 21 extends. The first cavity 26 is then closed by a fixed wedge 35 attached by screws (not shown) into screw cavities 38 to the body 32. In this way the rod 21 is fixed to the fixed base 32 having a fixed wedge 35. On the two anchors or end blocks 34, 35 the rear of the wedge plate protrudes 5 millimeters above the block surface 26 to allow the hammer to strike the wedge 35 and not the end block. This should relieve damage to the bearing on the rear anchor block and or damage to the thread on the front anchor block.

The spine being the rod 21 holds the plurality of intermediate wedge mounts 34 in a slidable manner between the fixed first base 32 and the adjustable second base 33 mounted at the second end 23 of the spine 21. The first fixed base 32 the rear anchor block the bearing 25 has 14 millimeter free play until it is stopped by the wedge plate 35 when reversing the clamp, this should relieve damage to the bearing, the tool itself as a whole and the timber that has just been fixed into position.

Figure 4:
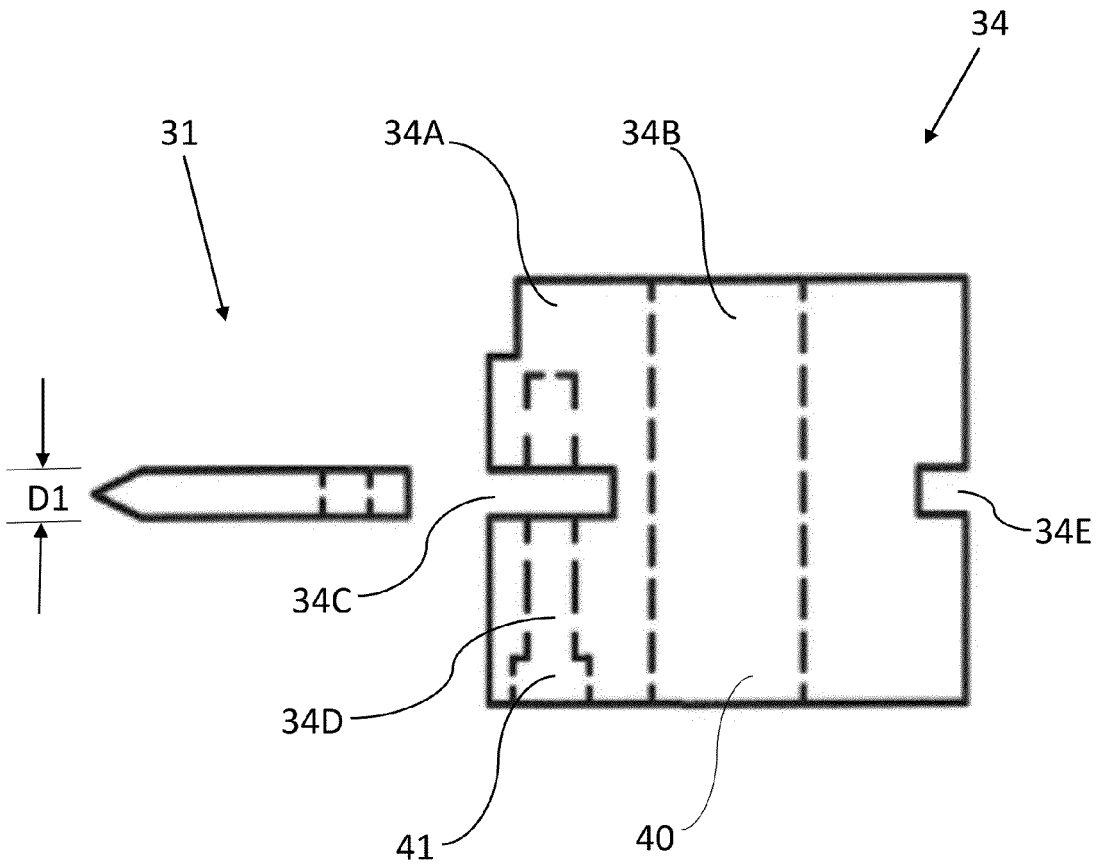
FIG. 4 is a detail of a wedge and an intermediate wedge mount when not mounted on the spine as part of the spacing means of FIG. 2.

As shown in FIG. 4 each of the intermediate wedge mounts 34 has a body 34A with a continuous channel 34B extending therethrough and sized to receive the rod 21 so as to allow mounting of the plurality of intermediate wedge mounts 34 on the rod 21. At one side of the body of the wedge mount 34 is a recess 34C for receiving a wedge 31 so that it extends away from the rod perpendicularly to the extension of the rod. The wedge 31 is locked in the recess by a locking pin 41 (not shown) extending into a locking pin channel 34D in the body 34A of the wedge mount 34 parallel to the channel 34B and extending through an aperture in the base of the wedge 31 and further extending into continuation of locking pin channel 34D on the other side of the wedge receiving recess 34C. In this way the wedge 31 is locked into the wedge mount 34 and provides each of the intermediate wedges 31 to be located in a particular orientation and constant spacing from the rod 21 and slidable along the rod 21.

Figure 9A:
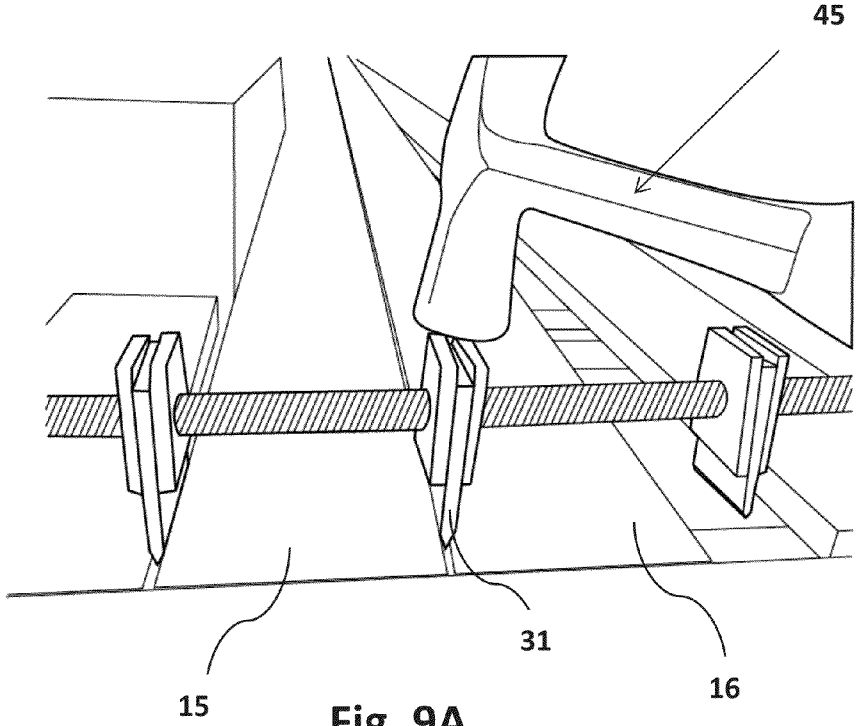
FIGS. 9A and 9B show two set up views of an embodiment of forcing the consistent spacing of the wedges of the spacing means in use.

As the spacing means is designed for forcing the wedges 31 between timber boards with force applied by a hammer, the body 34A of the wedge mount 34 has a 5 millimeter cut-out 34E on the opposite side to the recess 34C holding the wedge 31 and substantially aligned. This allows work hardening of the strike face at the back of the wedge mount 34 and relieve force from damaging the internal hole 34B of the spacing block formed by the wedge mount. The in use hammering of the rear of the wedge mount is shown in FIG. 9A.

Also with the plurality of intermediate wedge mounted in a slidable manner and with each of the wedges removably locked into the wedge mount by lock pin it is possible to replace broken or deformed wedges or to undertake replacement of different sized wedges. All wedges are removable for maintenance and or to use different thickness wedges, this means the tool could also be used to produce timber privacy screens and or timber fences with different spacings to decking timbers.

Figure 5:
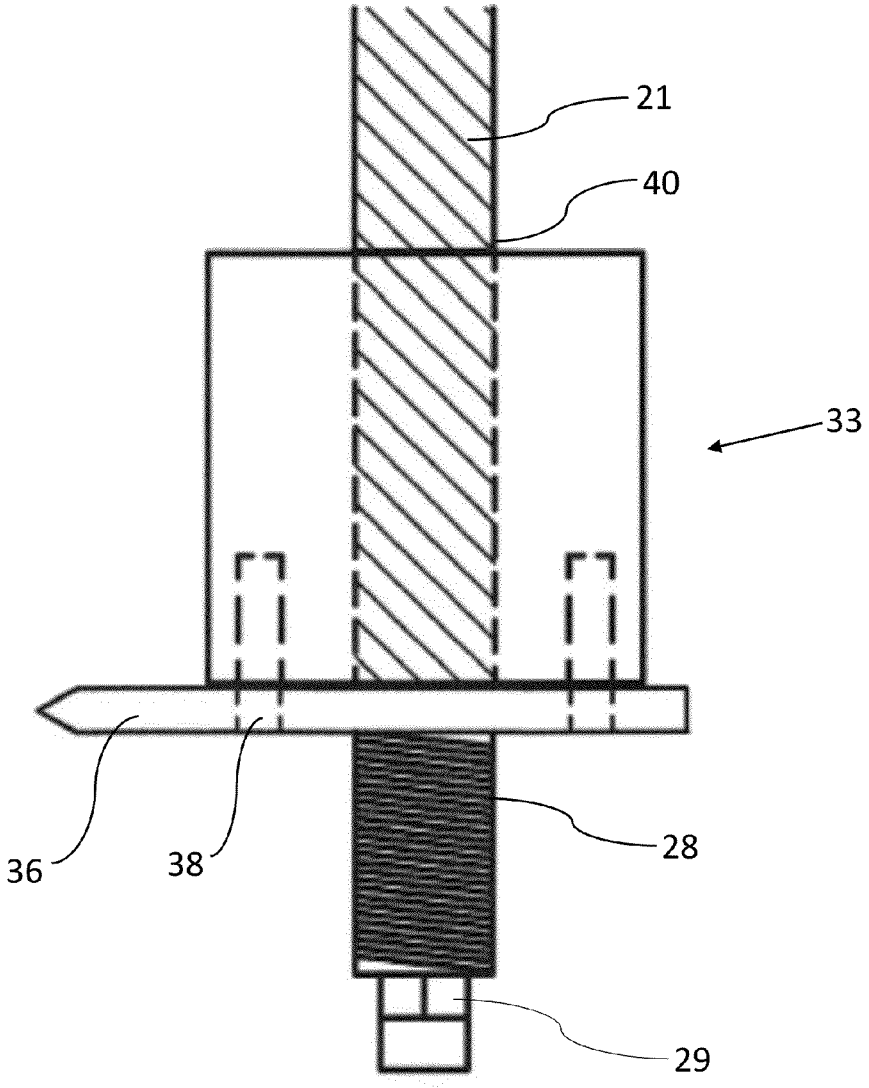
FIG. 5 is a detail of a second end of the spacing means of FIG. 2 showing a moveable base.

The plurality of wedges is each mounted on intermediate wedge mounts on the elongated spine between the first end and the second end. As shown in FIG. 5 the second end has a second end wedge mount 33 adjustably mounted on the spine 21. It can be seen that the spine of the spacing means holds the plurality of intermediate wedge mounts in a slidable manner from a base mounted at the first end or the second end of the spine.

The spacing means can use a clamping means in order to urge a plurality of intermediate wedge mounts 34 together slidably along the rod 21 while the respective plurality of wedges 31 can extend away from the rod and wedge between the plurality of elongated wooden decking timbers or fence palings in a planar manner.

The clamping means can be a separate C-type clamp. However clamping means could be a worm drive. More preferably the clamping means is a threaded means.

Therefore as shown particularly in FIG. 5 the spacing means has the spine as a rod 21 with the second end 23 being a partially threaded rod portion 28. The second end wedge mount 33 has a body with a channel extending therethrough 40 (like the intermediate wedge mounts 34) so as the second end wedge mount 33 can receive and be mounted on the rod 21. The end of the second end wedge mount 33 has a fixed wedge 36 that is screwed to the body of the second end wedge mount 33 by screws (not shown) into screw recesses 38 in the body.

The plurality of wedges each have a consistent first dimension D1 to allow consistent first dimensional spacing of the adjacent elongated wooden decking timbers or fence palings.

Referring to FIGS. 6 to 11 there is shown in a particular preferred form there is provided a spacing means which allows multiple boards (up to 10 depending on width of board) to be clamped in position ready to be fixed.

Figure 6:
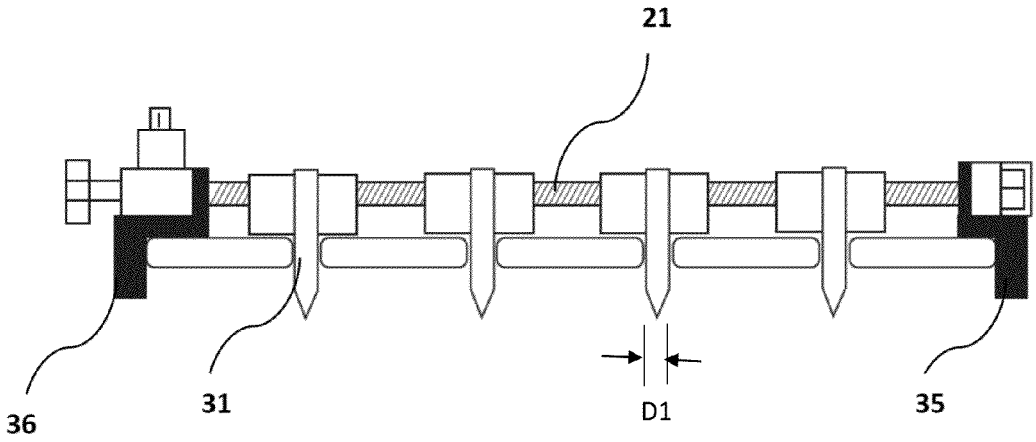
FIG. 6 is a diagrammatic view of an embodiment of the spacing means in use and FIG. 7 is a photographic view of an embodiment of the spacing means in use.
Figure 7:
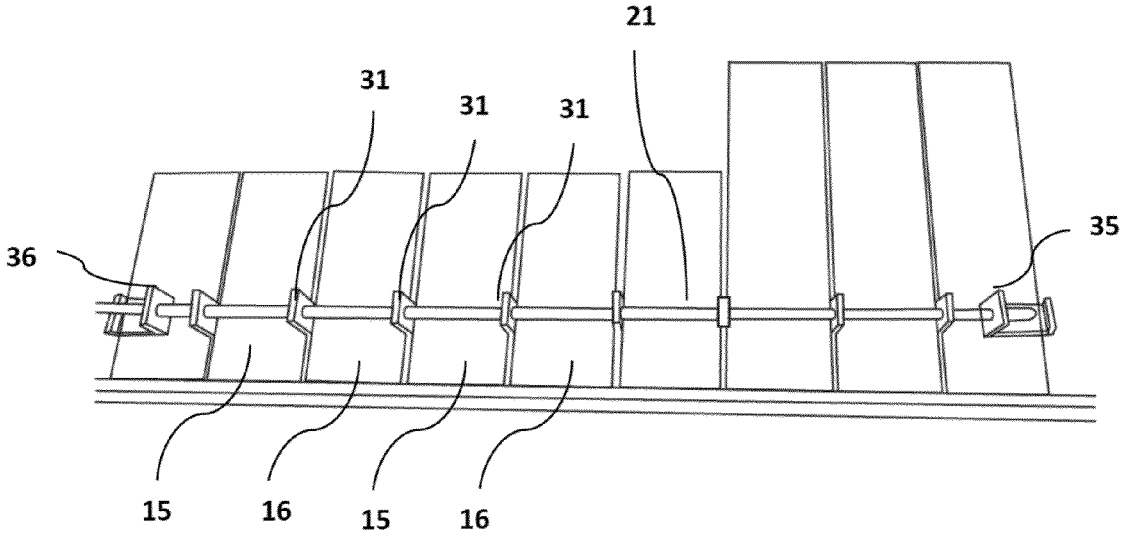

In FIGS. 6 and 7, the final arrangement of the spacing means is shown in cross sectional and perspective diagrammatic form. Meanwhile FIGS. 8A, 8B and 8C show how we arrive at that final arrangement.

It can be seen that there is a spacing means based on a spine rod 21 extending from a fixed connection 32 at one end to an adjustable connection 33 at the other. Mounted on the spine rod 21 are a plurality of spacing means in the form of wedges 31 between two end wedges 35 and 36 which are adjacent the fixed connection 32 at one end to an adjustable connection 33 at the other. A plurality of boards 15, 16 for adjacent parallel boards which need to be located in the fixed space to arrangement from one lateral side where one of the end wedges 35 and 36 are located to the opposing the lateral side where the other the end wedges 35 and 36 are located. In between our the plurality of wedges 31 fitting between the plurality of adjacent boards 15, 16 to provide assistance spacing of a are better affixed by nails screws or the like to the framework below. Similar arrangements can be undertaken at the same time with other spacing means which is preferable so as to remove many variations of deviations of the elongated slats over their up to 5 meter lengths.

Therefore it is achieved that the spacing means spaces the adjacent boards 15, 16 to an exact 5 millimeter spacing—as is the building industry accepted standard for hardwood timber. The invention will straighten bent boards and hold them in place ready for fixing. This is achieved as shown in FIGS. 8A, 8B and 8C and FIGS. 9A and 9B.

Figure 8A:
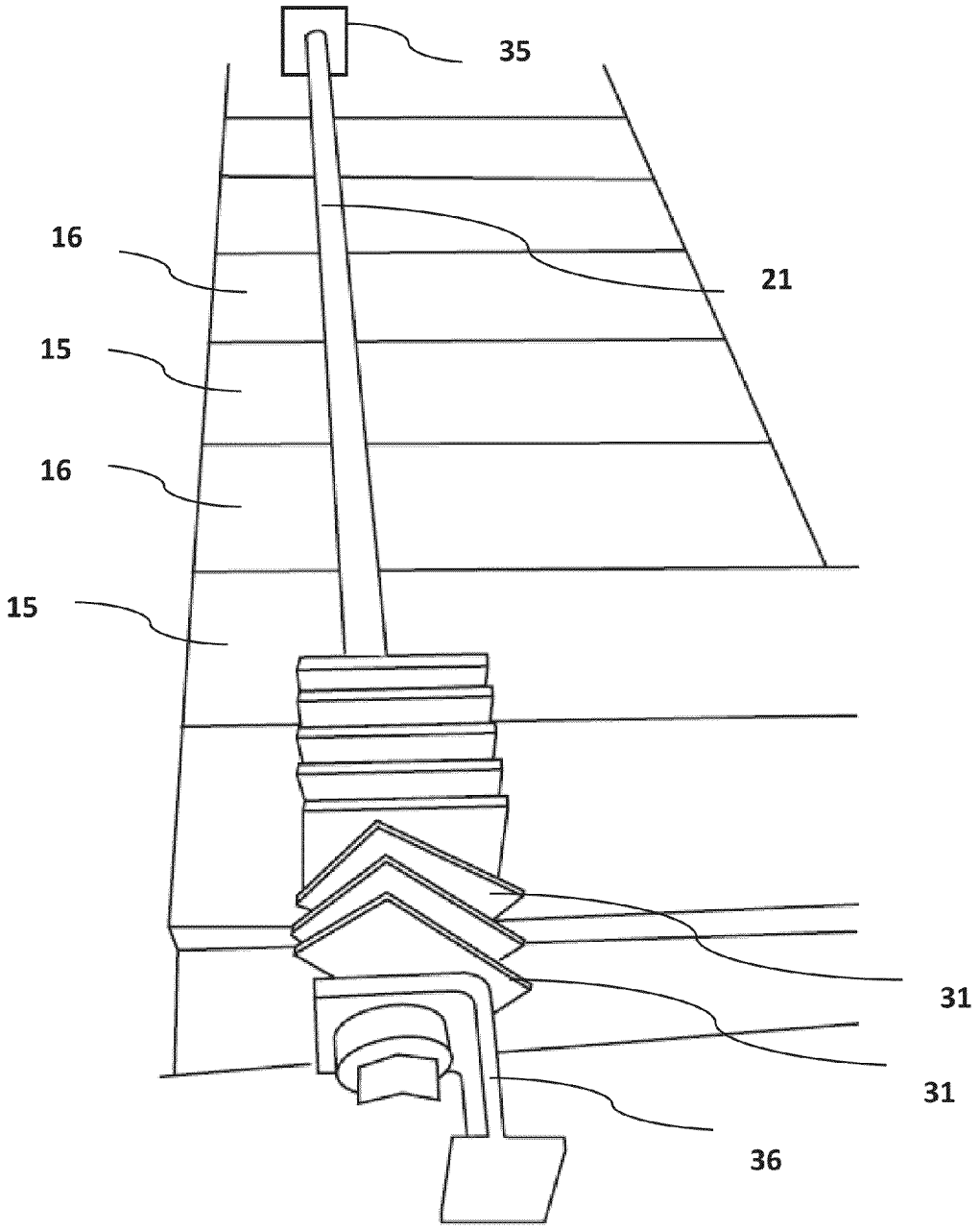
FIGS. 8A, 8B and 8C show three set up views of an embodiment of the spacing means in use.
Figure 8B:
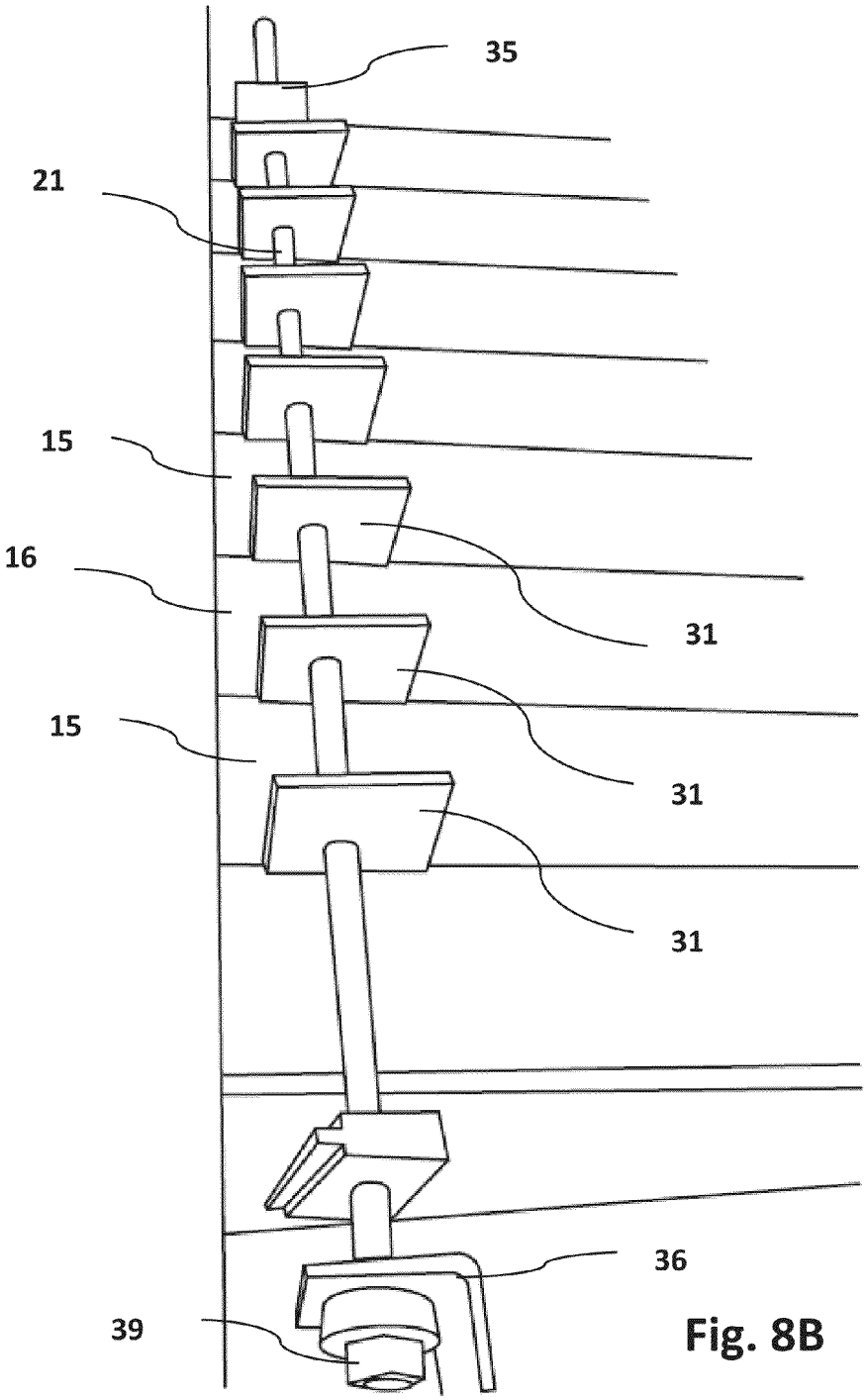
Figure 8C:
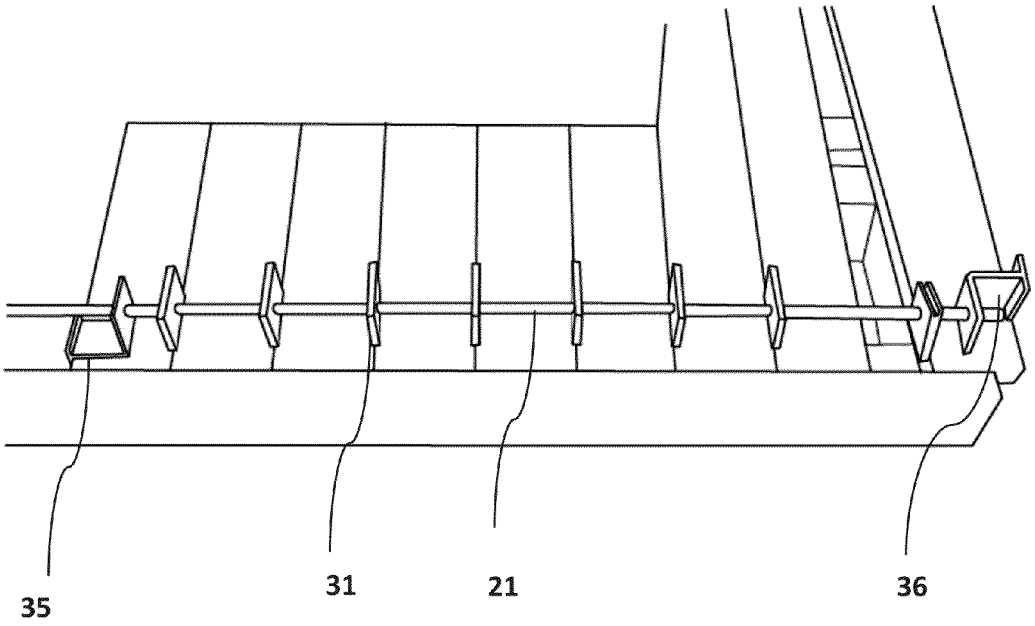

In FIG. 8A there is shown in that the plurality of wedge mounts 34 holding the wedges 31 are mounted on the spine rod 21 but are bunched at one end being the adjustable second end wedge-mount 33 at the second end 23. The fixed first end wedge mount 32 at the distant first end 22 of the spine rod 21 is located at the end of the plurality of boards to be spaced and fixed in planar fashion to form the decking. The fixed wedge 35 attached to the end of the fixed first end wedge mount 32 is hooked over the end of the furthest board and thereby creates the basis for spacing of all other boards extending substantially parallel beneath the laterally extending rod 21.

However as shown in FIG. 8B the intermediate wedge mounts 34 are then slidably moved along the rod 21 to be located between adjacent elongated wooden decking timbers or fence palings to be fixed in a planar manner to a supporting structure. As shown in FIG. 8C the wedges 31 are then inserted between the boards but clearly the spacing is not yet consistent.

Figure 9B:
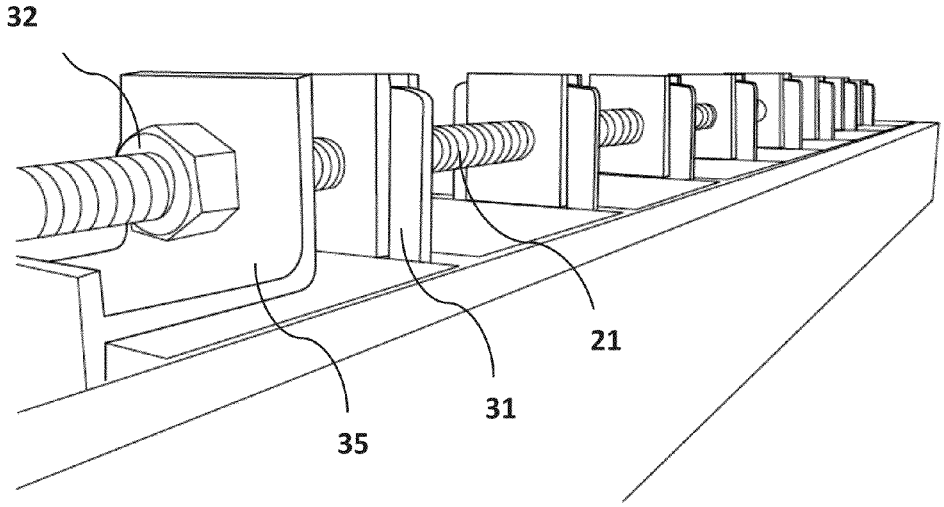

Referring to FIGS. 9A and 9B the wedge mounts 34 are forced between the boards to a consistent level and due to the wedges having opposing parallel sides and extending at a consistent level from the rod 21 the placing of the wedges 31 at a consistent depth fundamentally forms a consistent dimension D1 between adjacent boards.

Figure 10A:
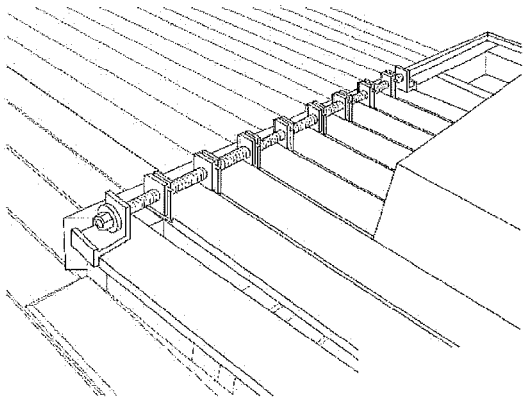
FIGS. 10A, 10B and 10C show three result views of an embodiment of the spacing means in use.
Figure 10B:
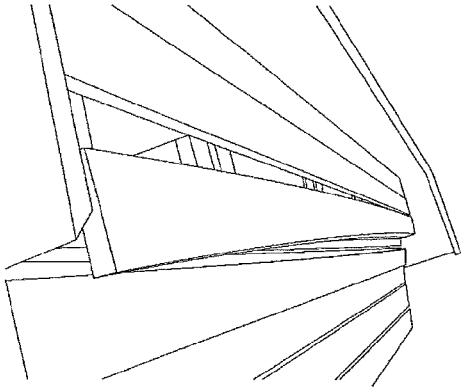
Figure 10C:
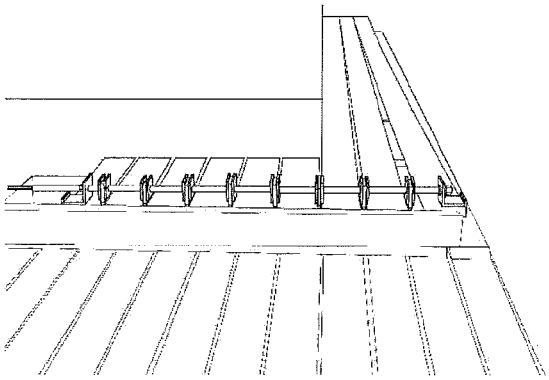

In FIGS. 10A, 10B and 10C the adjustable end wedge mount 33 at this second end 23 of the rod 21 has its fixed wedge 36 at the outermost end hooked over this end of the plurality of boards extending substantially parallel beneath the laterally extending rod 21. Therefore there are clear ends but spacing is not yet consistent.

Figure 11A:
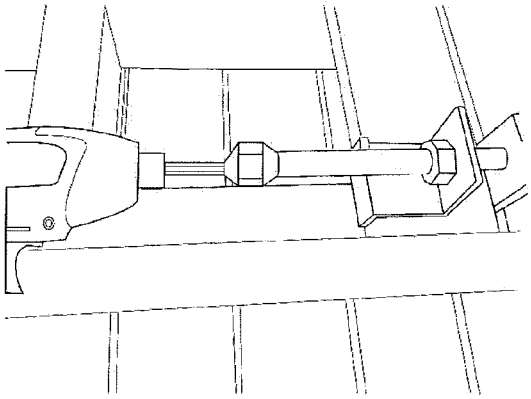
FIGS. 11A, 11B and 11C show three adjustment and attachment views of an embodiment of the spacing means in use.

As shown in FIG. 11A a clamping means is required for urging the plurality of intermediate wedge mounts 34 together slidably along the rod 21 while the respective plurality of wedges 31 can extend away from the rod and wedge between the plurality of adjacent elongated wooden decking timbers or fence palings in a planar manner. In this case this is achieved by a continuous threaded rod 21 that only needs to engage complementary thread in or adjacent the second adjustable end wedge mount 33. On the end of the threaded rod which is the driving mechanism of the clamp a M6 Socket head cap screw is thread into the centre. The M6 cap screw will be locked into position using a thread lock compound and a nylock nut as a secondary locking device. The M6 socket head cap screw will be compatible with a typical 5 millimeter Hex power bit which is commonly used in battery operated impact drivers or cordless drills. This part can be replaced when worn out for maintenance purposes.

Figure 11B:
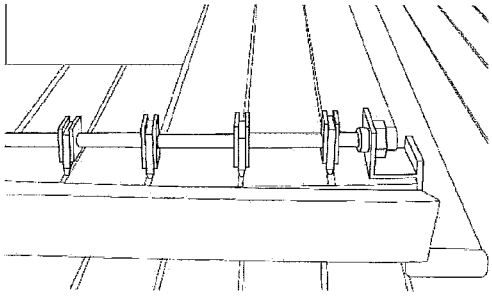
Figure 11C:
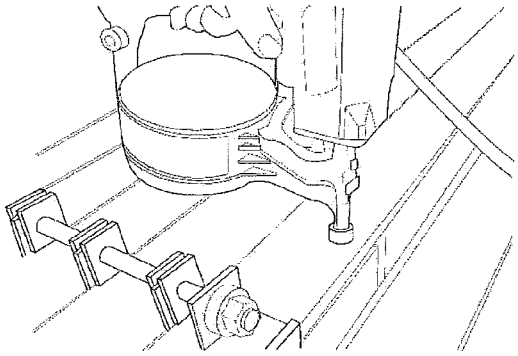

As shown in FIG. 11A a rotary drill can have a spanner attachment and rotate the end 29 of the rod 21 and thereby decrease the space between the distant first end wedge mount 32 and the adjustable second end wedge mount 33 at this end. In this way the intermediate wedge mounts 34 can continue to slide along the rod 21 with the wedges 31 extending between parallel boards until a certain tension is reached at which the boards are all pressed against the sides of the wedges at the required spacing as shown in FIG. 11B. Clearly excessive tension is not required as it is necessary to remove the spacing means after attaching the boards in the correct spacing position by nail gun or the like as shown in FIG. 11C. This can be achieved by all the blocks being both ends 32, 33 and the typical spacing blocks 34 have a 8 millimeter wide×3 millimeter high the width of the block, this feature is to allow a claw hammer or a small crow bar to assist in removing the tool once the timber is fixed in position.

A list of the benefits of your invention include

The spacing means is one tool that replaces consumable plastic packers, clamps and chisels The spacing means allows multiple decking boards to be fixed in position at one time which speeds up the decking job The spacing means straightens bent boards and holds them there to be fixed off and can be adjusted to the mm.

The spacing means can be used for various widths and thickness boards, most boards supplied today can vary 2 to 3 millimeter in width.

The spacing means can clamp boards together when directly against a wall or thresholds.

The spacing means has been designed to take the punishment of day to day life on the building site; it is designed to be hit with a hammer to allow the packer piece to wedge itself in between tight boards with no gap.

There any possible variations in functionality, structure or materials to the spacing means including a version which uses machined parts instead of welded parts. The material should be still steel and stainless steel all thread; however parts could be cast to safe machining costs.

The second version also allows for different size packer wedges to be installed. Both the original and second versions can be extended or reduced by simply changing the all thread component.

A worm drive can wind the clamp in however other clamping means are possible.

INTERPRETATION

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Throughout this document reference to timber or wood such as in terms of "elongated wooden decking timbers" or "fence palings" includes "elongated slats or fence palings" of wood or timber or other materials.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the A spacing means industries.

The claims defining the invention are as follows:

1. A spacing means for aiding spacing of a plurality of elongated slats or fence palings in a planar manner to a supporting structure, the spacing means comprising a. an elongated spine;

b. a first abutment member fixedly mounted at a first end of the elongated spine;

c. a second abutment member mounted on the elongated spine in a moveable manner between the first end and an opposing second end of the elongate spine;

d. a plurality of spacers mounted on the elongated spine in a moveable manner and arranged intermediate the first and second abutment members;

wherein, in use, the first abutment member is arranged to abut an outer edge of a first outer one of the plurality of elongated slats or fence palings, the second abutment member is arranged to abut an outer edge of a second outer one of the plurality of elongated slats or fence palings, each of the plurality of spacers is respectively positioned between adjacent elongated slats or fence palings between the first and second outer ones of the plurality of elongated slats or fence palings; once the abutment member and spacers are positioned, the second abutment member is moved along the elongate spine towards the first end, movement of the second abutment member causes the plurality of elongated slats or fence palings to move towards the first outer one of the plurality of elongated slats or fence palings and the plurality of spacers are clamped between adjacent elongated slats or fence palings while maintaining an appropriate spacing between adjacent elongated slats or fence palings.

2. The spacing means according to claim 1 wherein each of the plurality of spacers are mounted on intermediate spacer mounts on the elongated spine.

3. The spacing means according to claim 2 wherein the spine is a rod and holds the plurality of intermediate spacer mounts in a slidable manner with each of the spacers extending away from the rod.

4. The spacing means according to claim 2 wherein the spine is a rod and holds the plurality of intermediate spacer mounts in a slidable manner with each of the spacers removably locked into the spacer mount by lock pin to allow replacement of different spacers.

5. The spacing means according to claim 1 wherein the plurality of spacers each have a consistent width, wherein said width defines the appropriate spacing between adjacent elongated slats or fence palings.

6. The spacing means according to claim 1 wherein each of the plurality of spacers has a tapered wedge shape to assist in forcing a spacer between adjacent elongated slats or fence palings.

7. The spacing means according to claim 1 wherein the spine is a rod.

8. The spacing means according to claim 1 wherein the spine is a threaded rod engaging a threaded bearing at the first end of the elongated spine.

9. The spacing means according to claim 8, wherein the threaded rod provides a worm drive for moving the second abutment member in use.

10. The spacing means according to claim 8, wherein the threaded bearing is arranged with the first abutment member.

11. The spacing means according to claim 10 wherein each of the spacers extend perpendicularly away from the rod.

12. The spacing means according to claim 1 including a clamping means for urging a plurality of intermediate wedge mounts together slidably along the rod while the respective plurality of wedges can extend away from the rod and wedge between the plurality of elongated slats or fence palings in a planar manner.

* * * * *